US012502619B2

(12) United States Patent
Li

(10) Patent No.: US 12,502,619 B2
(45) Date of Patent: Dec. 23, 2025

(54) DRY ICE MACHINE FOR CREATING FOG EFFECT

(71) Applicant: Shen Yun Collections, INC., Cuddebackville, NY (US)

(72) Inventor: Hong-Zhi Li, Taipei (TW)

(73) Assignee: SHEN YUN COLLECTIONS, INC., Cuddebackville, NY (US)

( * ) Notice: Subject to any disclaimer, the term of this patent is extended or adjusted under 35 U.S.C. 154(b) by 761 days.

(21) Appl. No.: 17/760,219

(22) PCT Filed: Sep. 14, 2020

(86) PCT No.: PCT/US2020/050666
§ 371 (c)(1),
(2) Date: Aug. 5, 2022

(87) PCT Pub. No.: WO2022/055505
PCT Pub. Date: Mar. 17, 2022

(65) Prior Publication Data

US 2023/0063250 A1 Mar. 2, 2023

(51) Int. Cl.
*A63J 5/02* (2006.01)
*F25C 5/00* (2018.01)
(Continued)

(52) U.S. Cl.
CPC ..... *A63J 5/025* (2013.01); *F25C 5/00* (2013.01); *F25C 5/02* (2013.01); *F25C 5/04* (2013.01);
(Continued)

(58) Field of Classification Search
CPC .... A63J 5/025; F25C 5/00; F25C 5/02; F25C 5/04; F25C 5/08; F25C 5/10; F25D 2303/08; F25D 2303/081; F41H 9/06
See application file for complete search history.

(56) References Cited

U.S. PATENT DOCUMENTS 3,896,658 A * 7/1975 Hahn ..... F25D 3/12 62/383
4,349,723 A * 9/1982 Swiatosz ..... F41H 9/06 392/399
(Continued)

FOREIGN PATENT DOCUMENTS

CN 202569583 U * 12/2012
CN 107320981 A * 11/2017 ..... A63J 5/025
(Continued)

OTHER PUBLICATIONS

European Search Report issued on Apr. 30, 2024 for EP application No. 20953487.4.
(Continued)

*Primary Examiner* — Jianying C Atkisson
*Assistant Examiner* — Ibrahim A. Michael Adeniji
(74) *Attorney, Agent, or Firm* — McClure, Qualey & Rodack, LLP

(57) ABSTRACT

A dry ice machine for creating fog effect is provided. The dry ice machine includes an outer casing having a liquid containing space, a lifting assembly, a dry ice container, and a fog outlet pipe. The lifting assembly including a lifting member and an operating member is moveably disposed on the outer casing. The operating member is connected to the lifting member to drive the lifting member to move along a lifting axis. The dry ice container is detachably assembled to the lifting member to be driven up or down by the lifting member. The dry ice container has a plurality of through holes so that an internal space thereof is in spatial communication with the liquid containing space. The fog outlet pipe detachably assembled to the outer casing includes a backflow section and a bending section for guiding fog in the liquid containing space to the outside.

11 Claims, 9 Drawing Sheets

(51) Int. Cl.

| | |
|---|---|
| ***F25C 5/02*** | (2006.01) |
| ***F25C 5/04*** | (2006.01) |
| ***F25C 5/08*** | (2006.01) |
| ***F25C 5/10*** | (2006.01) |
| ***F41H 9/06*** | (2006.01) |

(52) U.S. Cl.
CPC ..... *F25C 5/08* (2013.01); *F25C 5/10* (2013.01); *F25D 2303/08* (2013.01); *F25D 2303/081* (2013.01); *F41H 9/06* (2013.01)

(56) References Cited

U.S. PATENT DOCUMENTS

| | | | | |
|---|---|---|---|---|
| 4,836,452 | A | 6/1989 | Fox | |
| 6,508,064 | B2 | 1/2003 | Tomita | |
| 7,162,826 | B1 * | 1/2007 | Zander | A01K 97/14 43/4 |
| 10,687,644 | B1 * | 6/2020 | Moore | F21V 33/0004 |
| 2003/0070447 | A1 * | 4/2003 | Tanaka | F25D 3/08 62/464 |
| 2004/0011073 | A1 * | 1/2004 | Blackstone | F24F 5/0017 62/425 |
| 2007/0012064 | A1 * | 1/2007 | Schock | F41H 9/06 62/425 |
| 2009/0033117 | A1 * | 2/2009 | Carpenter | B62K 19/46 296/1.07 |
| 2011/0296850 | A1 * | 12/2011 | McDonald | A47J 43/22 99/495 |
| 2020/0163375 | A1 * | 5/2020 | Ubakar | A24F 3/00 |
| 2022/0062783 | A1 * | 3/2022 | Chang | A63J 5/025 |

FOREIGN PATENT DOCUMENTS

| | | | | | |
|---|---|---|---|---|---|
| CN | 207119148 | U | | 3/2018 | |
| CN | 209221507 | U | | 8/2019 | |
| CN | 111437616 | A | | 7/2020 | |
| CN | 108721917 | B | * | 9/2023 | A63J 5/025 |
| DE | 19512814 | A1 | * | 10/1995 | F41H 9/06 |
| FR | 2 628 010 | A1 | | 9/1989 | |
| GB | 606970 | A | * | 8/1948 | A47J 43/22 |
| JP | 200338868 | A | | 2/2003 | |
| RU | 182603 | U1 | | 8/2018 | |

OTHER PUBLICATIONS

International Search Report issued in application No. PCT/US2020/050666.
Written Opinion dated Dec. 7, 2020.

* cited by examiner

DRY ICE MACHINE FOR CREATING FOG EFFECT

CROSS-REFERENCE TO RELATED PATENT APPLICATION

This application is the U.S. national stage of International Application PCT/US2020/050666, filed Sep. 14, 2020, which international application was published on Mar. 17, 2022, as International Publication No. WO 2022/055505, the contents of which are incorporated herein by reference in their entireties.

FIELD OF THE DISCLOSURE

The present disclosure relates to a dry ice machine for creating fog effect, and more particularly to a dry ice machine for creating fog effect on the stage.

BACKGROUND OF THE DISCLOSURE

Dry ice is solid carbon dioxide which can directly sublimate to gaseous phase when exposed to heat. Therefore, dry ice is often used on the stage to create fog effect. The operation principle of the conventional dry ice apparatus is to control the amount and timing of water fog produced by dry ice machine through water supply via pump. In details, the conventional dry ice apparatus includes a case, a hot water tank that is in spatial communication with the inside of the case, a water pump, and a container, the container being used for placing dry ice pellets and having an water outlet. The container loaded with dry ice pellets can be disposed in the outer casing.

When the dry ice apparatus produces water fog, hot water stored in the hot water tank is pumped into the case by the water pump to be in contact with the dry ice pellets in the container. In this way, dry ice pellets adsorbing heat will sublimate into gas and produce a lot of water fog. The water fog is then discharged to the outside of the case through a fog discharge orifice on the dry ice apparatus, producing an effect of permeating clouds on the stage.

However, the amount of water fog released per unit time by the conventional dry ice apparatus is limited. If the dry ice apparatus is to be used on a large stage, more machines as well as more time will be needed to generate enough amount of water fog. As the operation time grows longer, the temperature of the water in the conventional dry ice apparatus would gradually decrease, making the conventional dry ice apparatus unable to release enough amount of water fog. In addition, the water fog sprayed by the conventional dry ice apparatus may result in the formation of big water stains, increasing the risk of slipping and injury for performers on the stage.

Furthermore, during the operation of the conventional dry ice apparatus, an external power supply is required for the activation of the water pump, which may cause other safety problems. A case in point is that performers may be tripped over by the power cord used to connect the conventional dry ice apparatus to the power supply. If the water in the conventional dry ice apparatus overflows, the danger of electrical leakage or short circuit may also happen. The misoperation of the conventional dry ice apparatus may cause the power cord connecting the socket to fall off as well, making the dry ice apparatus stop working and consequently disturbing the performance.

Accordingly, how to improve the conventional dry ice apparatus to overcome the above-mentioned shortcomings is still one of the important issues to be solved in this industry.

SUMMARY OF THE DISCLOSURE

In response to the above-referenced technical inadequacies, the present disclosure provides a dry ice machine, which can release a large amount of water fog per unit time, and can prevent the formation of water stains on the stage, thereby increasing safety.

In one aspect, the present disclosure provides a dry ice machine for creating fog effect. The dry ice machine includes an outer casing having a liquid containing space, a lifting assembly, a dry ice container, and a fog outlet pipe. The lifting assembly includes a lifting member and an operating member. The lifting member is moveably disposed on the outer casing, and the operating member is connected to the lifting member to drive the lifting member to move along a lifting axis relative to the outer casing. The dry-ice container is detachably assembled to the lifting member and has a plurality of through holes so that an internal space of the dry ice container is in spatial communication with the liquid containing space of the outer casing. When the lifting member is ascended or descended, the dry ice container is driven by the lifting member to be ascended or descended. The fog outlet pipe is detachably assembled to the outer casing and includes a backflow section and a bending section for guiding the fog in the liquid containing space to the outside of the outer casing.

In certain embodiments, the outer casing includes a main housing surrounding the liquid containing space, a wall of the main housing has a hollow structure that is filled with a thermal insulation medium.

In certain embodiments, the outer casing includes a main housing surrounding the liquid containing space, the lifting member has a U-shaped structure, and the U-shaped structure is disposed on a wall of the main housing with an opening thereof facing toward the main housing.

In certain embodiments, the lifting member includes an inner plate body extending into the liquid containing space, an outer plate body located outside of the outer casing, and a bridging portion connected between the inner plate body and the outer plate body, and the operating member is connected to the outer plate body.

Further, the lifting assembly further includes a support portion for supporting the dry ice container, the support portion is connected to the inner plate body, and when the dry ice container is disposed in the liquid containing space, the support portion is located at the bottom of the dry ice container.

In certain embodiments, the outer casing includes a main housing defining the liquid containing space, and the lifting assembly further includes a guide member disposed on an outer side wall of the main housing and having a trench extending along the lifting axis, the lifting member is movably disposed between the guide member and the main housing, and the operating member is connected to the lifting member through the trench.

In certain embodiments, the operating member includes a pin portion and a grip portion connected to each other. When the operating member is in a fixed state, the pin portion penetrates the lifting member and abuts against the main housing. When the operating member is in a fixed state, the pin portion penetrates the lifting member and abuts against the main housing. When the operating member is in a movable state, the pin portion is connected to the lifting member without being in contact with the main housing.

In certain embodiments, the main housing further includes a plurality of positioning structures, and the positioning structures are located at an outer side wall of the main housing and arranged corresponding to a moving path of the lifting member. when the operating member is in a fixed state, the pin portion is engaged with one of the positioning structures.

Furthermore, the operating member further includes an elastic element and a flange protruding from the front end of the pin portion, and two ends of the elastic element are respectively connected to the flange and the lifting member.

In certain embodiments, the outer casing further includes a top cover that closes the liquid containing space. The backflow section is detachably assembled on the top cover. An extension direction of the backflow section and the lifting axis jointly form an acute angle therebetween. The bending portion has a spout and is bent relative to the extension direction of the backflow section to form a bending angle, the bending angle being greater than the acute angle formed between the extension direction of the backflow section and the lifting axis.

In certain embodiments, the dry ice machine further includes a heating assembly disposed in the liquid containing space to heat the liquid.

In certain embodiments, the dry ice machine further includes a control module and a temperature sensor. The temperature sensor is disposed in the liquid containing space to detect the temperature of the liquid, and the control module is electrically connected to the heating assembly and the temperature sensor, and controls the power provided to the heating assembly according to the temperature detected by the temperature sensor.

Therefore, one of the advantages of the present disclosure is that in the dry ice machine provided herein, by technical features of "the lifting member being movably disposed on the hosing," and "the dry ice container being driven to ascend or descend when the lifting member is ascended or descended," and "the fog outlet pipe being detachably assembled on the outer casing and including the backflow section and the bending section connected to each other, so as to guide the fog generated in the liquid containing space to the outside," a large amount of water fog can be released per unit time, meanwhile, the formations of water stains can be prevented, thereby improving the safety.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
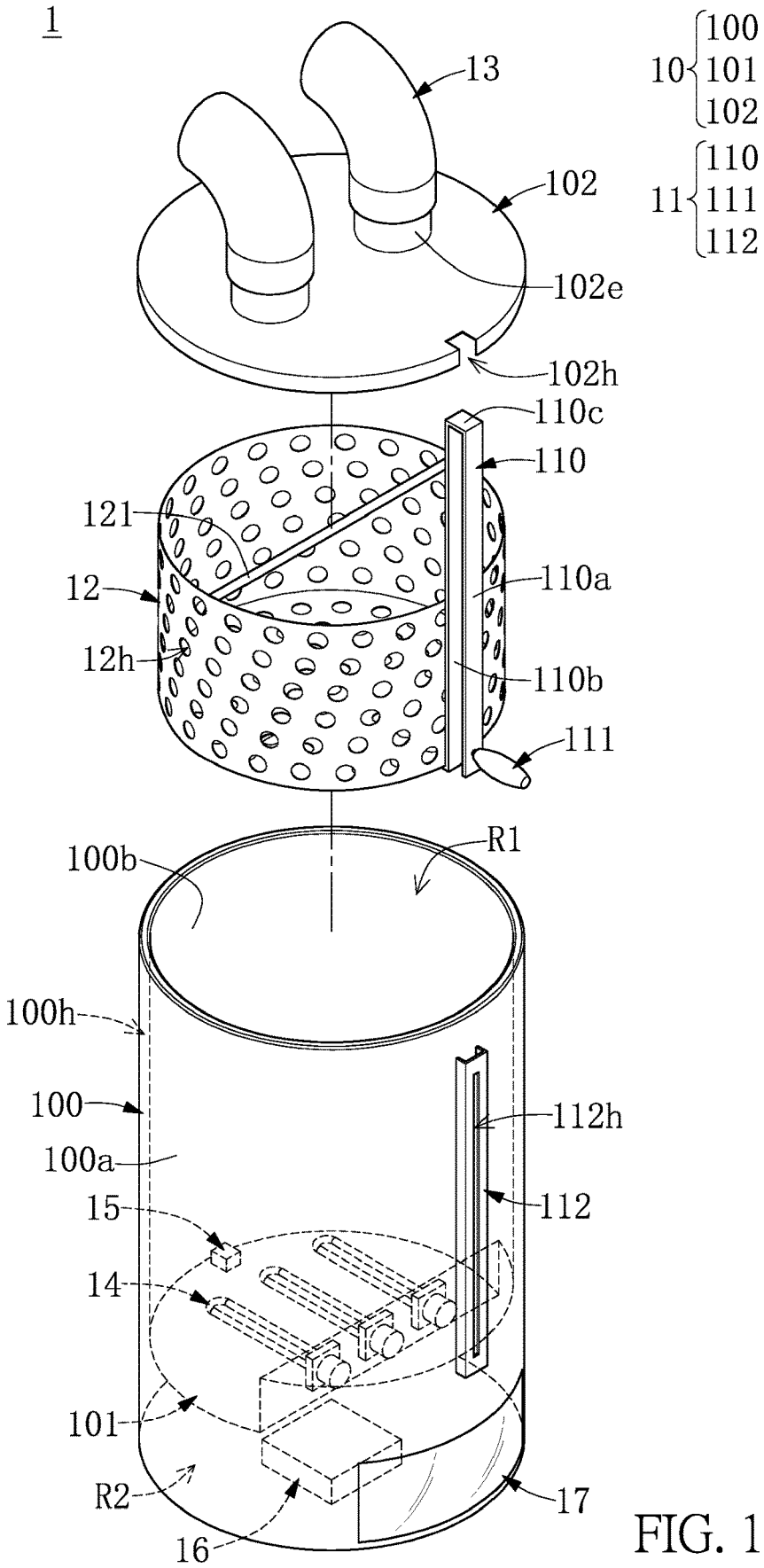
FIG. 1 is a perspective exploded view of a dry ice machine according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
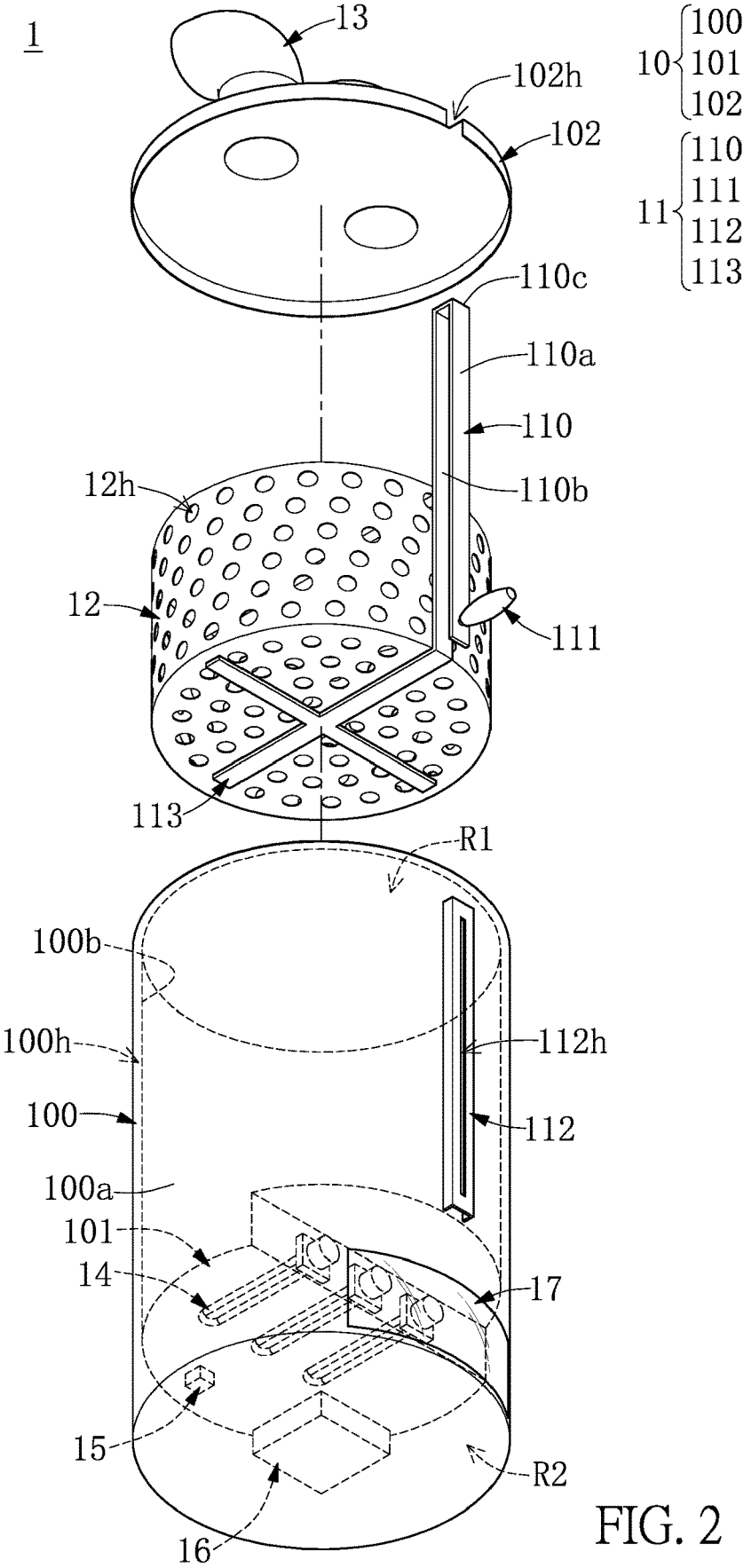
FIG. 2 is a perspective exploded view of the dry ice machine viewed from another side according to the embodiment of the present disclosure.
Figure 3:
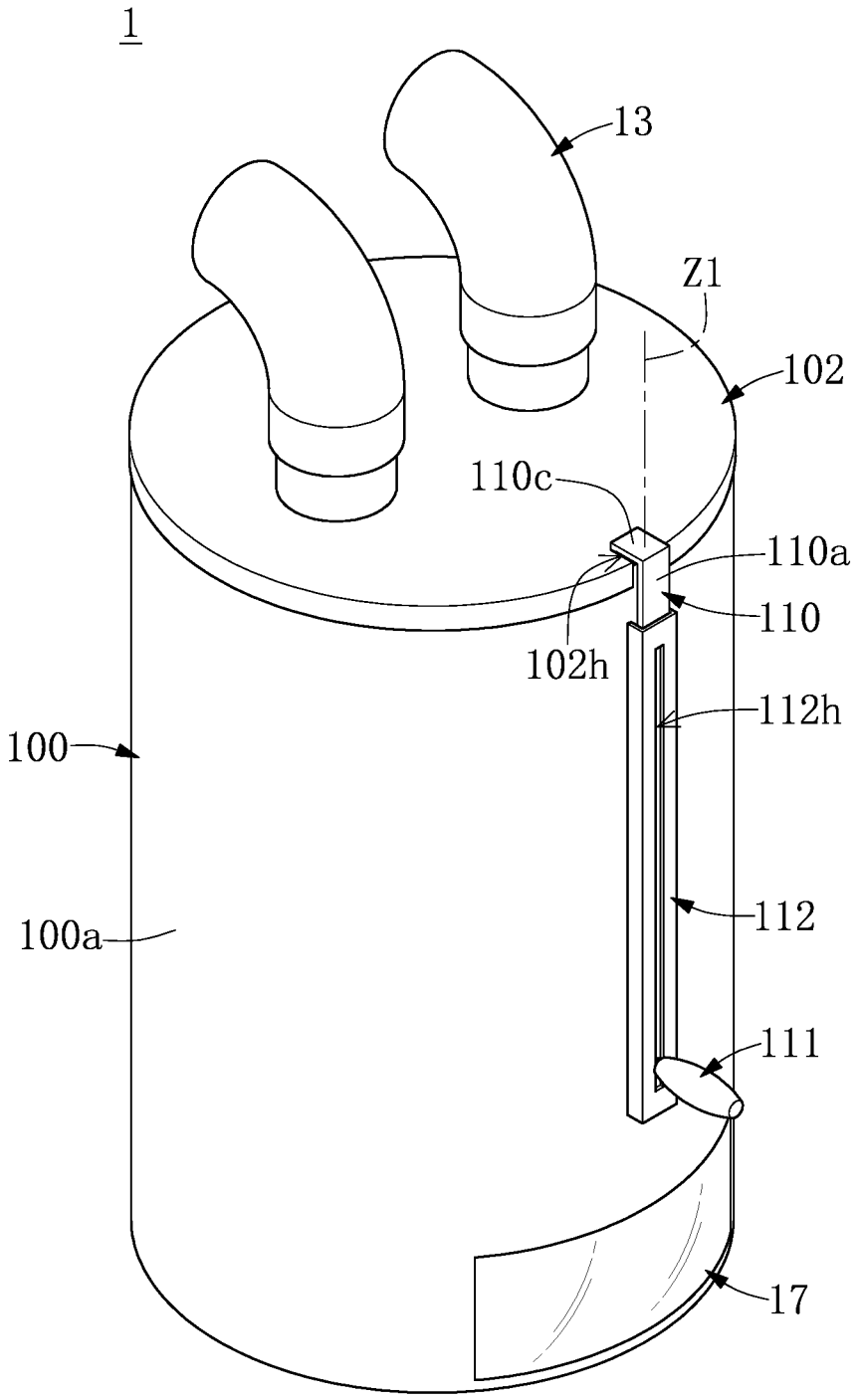
FIG. 3 is a perspective assembled view of the dry ice machine according to the embodiment of the present disclosure.

Reference is made to FIG. 1 to FIG. 3. In an embodiment of the present disclosure, a dry ice machine 1, which can be used to generate fog to create fog effects during performances, is provided. In the instant embodiment, the dry ice machine 1 includes: an outer casing 10, a lifting assembly 11, a dry ice container 12 and a fog outlet pipe 13.

The outer casing 10 includes a main housing 100 and a top cover 102. In this embodiment, the outer casing 10 further includes a partition structure 101 located near the bottom side thereof to divide the internal space of the main housing 100 into a liquid containing space R1 and an electric control room R2 that are independent and isolated from each other. As shown in FIG. 1, the liquid containing space R1 is defined between the partition structure 101 and the top cover 102, and the electric control room R2 is defined between the partition structure 101 and the bottom plate of the main housing 100.

The liquid containing space R1 of the main housing 100 can be used to contain liquid (such as water). By using the heated liquid being in contact with dry ice pellets, the sublimation of the dry ice pellets would be facilitated, and then fog can be produced in the liquid containing space R1. The more the amount of liquid stored in the main housing 100, the greater the heat capacity of the liquid, and the longer the duration of generating the fog effects when the dry ice pellets are in contact with the liquid. In this embodiment, the main housing 100 is in cylindrical shape so as to carry the largest amount of liquid in the limited volume.

Reference is made to FIG. 1. In this embodiment, the wall of the main housing 100 has a hollow structure 100*h*, and a thermal insulation medium is filled in the hollow structure 100*h*. The aforementioned thermal insulation medium is, for example, air or foam.

Specifically, the main housing 100 of the outer casing 10 in the embodiment of the present disclosure has a double-layered side wall. As shown in FIG. 1, the main housing 100 has an inner side wall 100*b* and an outer side wall 100*a* opposite to the inner side wall 100*b*, and the inner side wall 100*b* and the outer side wall 100*a* jointly define a hollow structure 100*h*.

During the dry ice pellets being in contact with water (liquid) to produce fog and smoke, the dry ice pellets absorb heat from the water and cause the temperature of the water to decrease. If the temperature of the water in the outer casing 10 decreases too rapidly, or even decreases to the freezing point of the water, it is not easy to continuously generate a sufficient amount of cloud or mist by the sublimation of the dry ice pellets. Therefore, before the dry ice machine 1 is operated, the liquid in the outer casing 10 has been heated to a specific temperature, such as of 70° C. to 80° C. In the embodiment of the present disclosure, the main housing 100 has a hollow structure 100*h* filled with a thermal insulation medium so as to slow down the cooling rate of the liquid, maintain the temperature of the liquid at a relatively high temperature, and prevent an operator from being burned.

Figure 4:
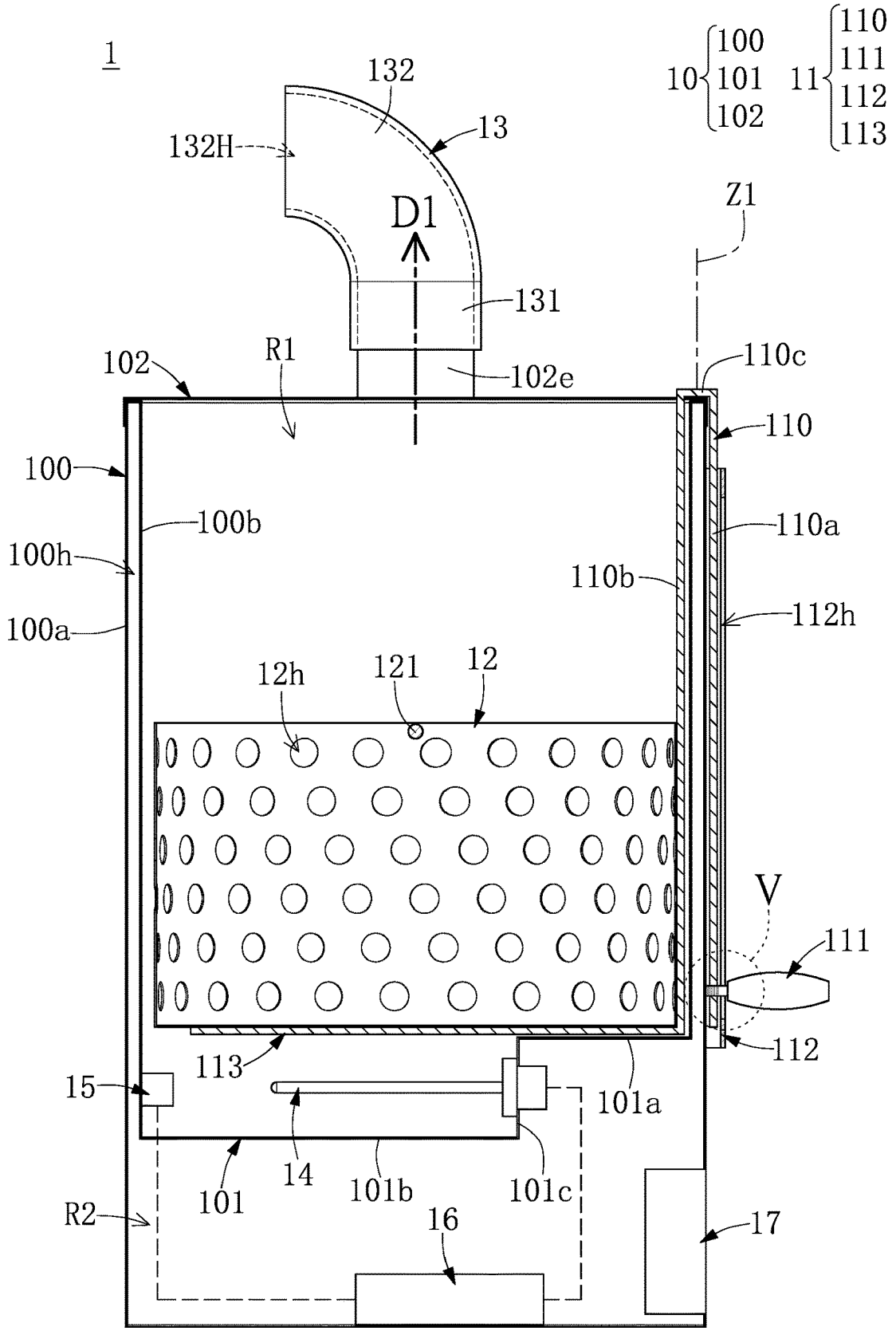
FIG. 4 shows a cross-sectional view of the dry ice machine shown in FIG. 3.

Reference is made to FIG. 1, FIG. 2 and FIG. 4 again. FIG. 4 is a schematic cross-sectional view of the dry ice machine shown in FIG. 3. In the instant embodiment, the dry ice machine 1 further includes a heating assembly 14, a temperature sensor 15, and a control module 16.

The heating assembly 14 is disposed in the liquid containing space R1 for heating the liquid. In the instant embodiment, the heating assembly 14 includes a plurality of heat pipes, and the heat pipes are assembled to the partition structure 101 and located at the bottom of the liquid containing space R1. Referring to FIG. 4, specifically, the partition structure 101 of the instant embodiment has a stepped portion that including a first step surface 101*a*, a second step surface 101*b*, and a connection surface 101*c*, the connection surface 101*c* being connected between the first step surface 101*a* and the second step surface 101*b*. In addition, the heating assembly 14 is assembled to the connection surface 101*c* of the stepped portion and extends from the connection surface 101*c* along the second step surface 101*b*. In other words, the heat pipes of the heating assembly 14 do not protrude from the first step surface 101*a* to prevent interference with the dry ice container 12.

The temperature sensor 15 is disposed in the liquid containing space R1 to detect the temperature of the liquid. The control module 16 is disposed in the electric control room R2 and is electrically connected to the heating assembly 14 and the temperature sensor 15. In one embodiment, the control module 16 can receive the signal detected by the temperature sensor 15 and control the power provided to the heating assembly 14 according to the signal from the temperature sensor 15.

In the instant embodiment, the dry ice machine 1 further includes an operating panel 17 which is electrically connected to the control module 16. In addition, the operating panel 17 is disposed at the outside of the main housing 100 for receiving the user's instructions. The operating panel 17 can further include, a display for displaying the temperature detected by the temperature sensor 15. The operating panel 17 may also include, but not limited to, a control key, a control button, a control panel or any combination thereof to allow a user to turn on or off the heating assembly 14 through the operating panel 17 and to input instructions according to the temperature displayed on the display. The user can control the number of heat pipes required to be turned on through the control module 16 adjusting the power. In an embodiment, the operating panel 17 may be a touch panel.

As shown in FIG. 1 and FIG. 3, the top cover 102 is detachably assembled on the main housing 100 to (partially) close the liquid containing space R1. In the instant embodiment, the side edge of the top cover 102 has a passing notch 102*h* to prevent interference with the operation of the lifting assembly 11. In addition, as shown in FIG. 1, the top cover 102 further includes at least one engagement structure 102*e* (two engagement structures are shown to be exemplified), so that the fog outlet pipe 13 can be assembled on the top cover 102. The engagement structure 102*e* can be, for example, an opening or a protrusion pipe, but the present disclosure is not limited thereto.

Reference is made to FIG. 1 to FIG. 4. The lifting assembly 11 includes a lifting member 110 and an operating member 111. In the instant embodiment, the lifting member 110 is movably disposed on the outer casing 10, and the operating member 111 is connected to the lifting member 110 to drive the lifting member 110 to move relative to the outer casing 10 along a lifting axis Z1.

Reference is made to FIG. 1 and FIG. 4. The lifting member 110 of the instant embodiment has a U-shaped structure, and an opening of the U-shaped structure faces toward the main housing 100 such that the lifting member 110 can be disposed on the wall of the main housing 100. Furthermore, the lifting member 110 includes an inner plate body 110*b*, an outer plate body 110*a*, and a bridging portion 110*c* connected between the inner plate body 110*b* and the outer plate body 110*a*. As shown in FIG. 4, the bridging portion 110*c* is straddled on the wall of the main housing 100. In addition, the inner plate body 110*b* extends downwardly from one end of the bridging portion 110*c* along the inner side wall 100*b* into the liquid containing space R1, and the outer plate body 110*a* extends downwardly from the other end of the bridging portion 110*c* along the outer side wall 100*a*, and located at the outside of the main housing 100.

In the instant embodiment, the lifting assembly 11 further includes a guide member 112 to restrict a moving path of the lifting member 110. As shown in FIG. 3 and FIG. 4, the guide member 112 of this embodiment is disposed on the outer side wall 100*a* of the main housing 100, and the lifting member 110 is movably disposed between the guide member 112 and the outer side wall 100*a* of the main housing 100. Specifically, a cross-sectional shape of the guide member 112 is substantially in C-shape. That is to say, in this embodiment, the guide member 112 has a main panel portion (not labeled) and two lateral panel portions (not labeled) respectively connected to two opposite sides of the main panel portion. The two lateral panel portions are bent relative to the main board portion and extends toward the outer side wall 100*a* of the main housing 100. The outer plate body 110*a* of the lifting member 110 is disposed in the space defined by the main panel portion and the two lateral panel portions. Therefore, when the lifting member 110 is driven to move relative to the guide member 112, the two lateral panel portions of the guide member 112 can prevent the lifting member 110 from deviating from the lifting axis Z1. Accordingly, the lifting member 110 can linearly move along the lifting axis Z1 relative to the guide member 112.

In addition, the guide member 112 has a trench 112*h*. The trench 112*h* is located at the main panel portion and extends along the lifting axis Z1. The operating member 111 passes through the trench 112*h* to be connected to the lifting member 110. In this way, the user can hold and move the operating member 111 along the trench 112*h* to drive the lifting member 110 to linearly move in the lifting axis Z1.

Figure 5A:
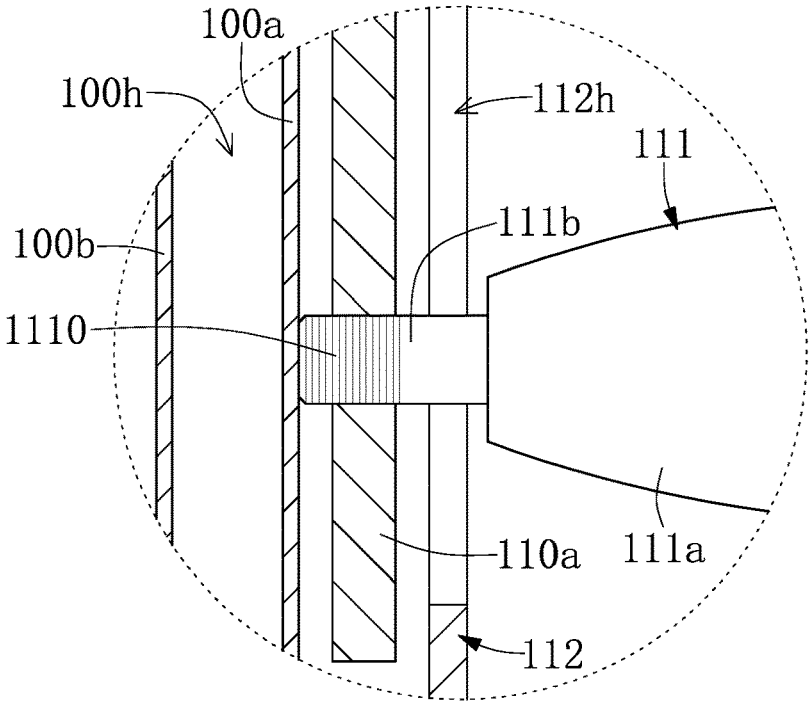
FIG. 5A shows an enlarged view of part V of the dry ice machine shown in FIG. 4.

Reference is made to FIG. 4 and FIG. 5A. FIG. 5A shows a partial enlarged view of the operating member shown in FIG. 4. As shown in FIG. 5A, in the instant embodiment, the operating member 111 includes a grip portion 111*a* and a pin portion 111*b*. The grip portion 111*a* can be gripped by the user to control the movement of the lifting member 110. The pin portion 111*b* is connected to the grip portion 111*a* and passes through the trench 112*h* of the guide member 112 so as to be connected to the outer plate body 110*a* of the lifting member 110. Furthermore, when the operating member 111 is in a fixed state, the pin portion 111*b* penetrates through the outer plate body 110*a* of the lifting member 110, and abuts against the outer side wall 100*a* of the main housing 100, so that the lifting member 110 is fixed on a preset position. In other words, when the pin portion 111*b* abuts against the outer side wall 100*a* of the main housing 100, the lifting member 110 is also fixed and thus cannot be moved relative to the guide member 112.

As shown in FIG. 5A, in an embodiment, a front end of the pin portion 111*b* has a thread structure 1110, and the outer plate body 110*a* has a screw hole (not labeled). The thread structure 1110 of the pin portion 111*b* is engaged with the screw hole, so that the pin portion 111*b* is connected to the outer plate body 110*a*, but the present disclosure is not limited thereto. In another embodiment, the pin portion 111*b* and the outer plate body 110*a* can also be matched with each other by another engagement structures.

Figure 5B:
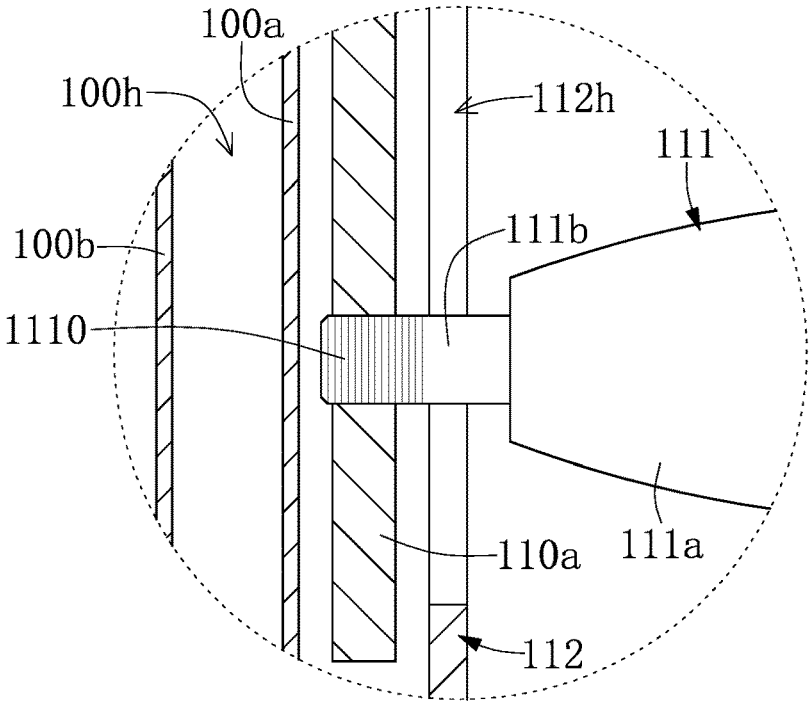
FIG. 5B shows an enlarged view of the operating member shown in FIG. 4 in a movable state.

Reference is made to FIG. 5B, which shows a partial enlarged view of the operating member of FIG. 4 in a movable state. When the pin portion 111*b* is connected to the outer plate body 110*a* but not in contact with the outer side wall 100*a* of the main housing 100, the lifting member 110 is allowed to move relative to the guide member 112. Accordingly, when the position of the lifting member 110 needs to be adjusted, the user can rotate the grip portion 111*a* until the pin portion 111*b* is separated from the outer side wall 100*a* of the main housing 100. Thereafter, by holding and moving the grip portions 111*a*, the lifting member 110 can be driven to move relative to the guide member 112.

Reference is made to FIG. 2 and FIG. 4 again. The lifting assembly 11 further includes a support portion 113 for supporting the dry ice container 12. The support portion 113 is arranged in the liquid containing space R1 and connected to the inner plate body 110*b* of the lifting member 110. When the dry ice container 12 is disposed in the liquid containing space R1, the dry ice container 12 may be disposed on and supported by the support portion 113. The structure of the support portion 113 may be in a cross shape, a star shape, or any one of other shapes. As long as the support portion 113 has a sufficient structural strength to support the weight of the dry ice container 12 with the dry ice pellets, and allows the liquid stored in the liquid containing space R1 to flow into the dry ice container 12, the structure of the support portion 113 is not limited to the examples provided in the present disclosure.

As shown in FIG. 1 to FIG. 3, the dry ice container 12 used for carrying dry ice pellets is detachably assembled to the lifting assembly 11. The dry ice container 12 has a plurality of through holes 12*h*, so that an internal space of the dry ice container 12 is in spatial communication with the liquid containing space R1. When the dry ice container 12 is assembled to the lifting assembly 11, a height position of the dry ice container 12 can be changed by holding and moving the operating member 111 to drive the lifting member 110 to move along the lifting axis Z1. The height position refers to a height level of the bottom end of the dry ice container 12 relative to the second step surface 101*b*. When the lifting member 110 is ascended or descended, the dry ice container 12 is driven to ascend or descend so as to control a contact area between the dry ice pellets and the liquid. The operation method of the dry ice machine 1 will be described later.

The larger the liquid containing space R1, the larger the liquid storage capacity. As such, the slower the cooling rate of the liquid, and the longer the duration of generating fog. Accordingly, the ratio between the volume of the liquid containing space R1 and the volume of the dry ice container 12 can be determined according to actual requirements, and the present disclosure is not limited thereto. In addition, the dry ice container 12 of the instant embodiment further includes a handle 121 which is more convenient for a user to dispose the dry ice container 12 on the support portion 113 of the lifting assembly 11 or to take the dry ice container 12 out of the main housing 100.

As shown in FIG. 1 to FIG. 3, the fog outlet pipe 13 is detachably assembled to the outer casing 10 to guide the fog generated in the liquid containing space R1 to the outside. In the instant embodiment, the fog outlet pipe 13 is detachably assembled on the top cover 102.

Reference is made to FIG. 1 and FIG. 4. The fog outlet pipe 13 includes a backflow section 131 and a bending section 132. In the instant embodiment, the engagement structure 102*e* of the top cover 102 is a protrusion pipe, and one of the end portions of the backflow section 131 is sleeved on the protrusion pipe, so that the fog outlet pipe 13 can be detachably assembled on the top cover 102. The backflow section 131 extends upwardly (i.e., in a direction away from the bottom of the main housing 100), and an extension direction D1 of the backflow section 131 and the lifting axis Z1 jointly form an acute angle therebetween. Preferably, the acute angle formed between the extension direction D1 of the backflow section 131 and the lifting axis Z1 ranges between 0 and 45 degrees. Although the extension direction D1 shown in FIG. 1 to FIG. 4 is substantially parallel to the lifting axis Z1, the present disclosure is not limited thereto.

The bending section 132 is connected to the backflow section 131 and has a spout 132H. The bending section 132 is bent relative to the extension direction D1 of the backflow section 131 to form a bending angle, and defines (determines) a fog outlet direction. In the instant embodiment, the fog generated in the main housing 100 is guided to the outside of the dry ice machine 1 through the spout 132H of the bending section 132. In the instant embodiment, the bending angle of the bending section 132 is greater than the acute angle formed between the extension direction D1 of the backflow section 131 and the lifting axis Z1.

It should be noted that after the dry ice pellets are in contact with the liquid, the dry ice pellets absorbing heat will sublimate into gas and produce a large amount of fog. The fog passing through the fog outlet pipe 13 and flowing out of the dry ice machine 1 usually contains a large amount of water droplets (or condensation). With the gradual diffusion of fog on the stage, the water droplets (or condensation) in the fog will condense on the ground and form a water film, thereby increasing the risk of slipping for performers on the stage. Given a conventional dry ice apparatus, the more the amount of discharged fog, the more water droplets the fog contains. Such phenomenon can prompt the formation of water stains on the floor and lead to a more slippery stage. In contrast, if the amount of discharged fog is reduced, the effect of permeating clouds might not be seen on the stage, especially a large one.

Accordingly, in the present disclosure, the extension direction D1 of the backflow section 131 of the fog outlet pipe 13 is not only different from the fog outlet direction, but also forms an acute angle with the lifting axis Z1 so as to reduce the humidity of the fog and overcome the above-mentioned problems. Specifically, when the fog generated in the main housing 100 passes through the backflow section 131, the water droplets (or condensation) contained in the fog may condense on the inner wall surface of the backflow section 131. Since the extension direction D1 of the backflow section 131 is substantially parallel to a vertical direction, the water droplets (or condensation) condensed on the inner wall surface of the backflow section 131 can flow back into the liquid containing space R1.

Moreover, since the extension direction D1 of the backflow section 131 of the fog outlet pipe 13 is different from the fog outlet direction, when the fog is discharged from the fog outlet pipe 13, it is less likely for the water droplets condensed on the backflow section 131 to be brought onto the stage. As such, the water droplets contained in the fog discharged from the fog outlet pipe 13 will be decreased, thus reducing the formation of a water film on the stage. In short, the dry ice machine 1 of the embodiment of the present disclosure can not only produce a large amount of fog to achieve the expected cloud effect, but also prevent water stains from being formed on the stage, reducing the risk of slipping for performers on the stage floor.

It should be noted that although the fog outlet pipe 13 of this embodiment is disposed on the top cover 102, the present disclosure is not limited thereto. In another embodiment, the fog outlet pipe 13 can also be assembled on the main housing 100 instead. As long as the fog outlet pipe 13 includes the backflow section 131 extending upward and the bending section 132, and the acute angle formed between the extension direction D1 and the lifting axis Z1 does not exceed 90 degrees (preferably does not exceed 45 degrees), the humidity of the fog can be reduced.

In the present disclosure, the flow rate and humidity of the fog can be controlled by adjusting the length of the backflow section 131 and the aperture of the spout 132H. For example, a relatively larger aperture of the spout 132H will at the same time lead to a larger flow rate and a higher humidity of the fog. However, if the length of the backflow section 131 is increased, the humidity of the fog will be lowered. The aperture of the spout 132H and the length of the backflow section 131 can thus be adjusted according to actual requirements.

Figure 6:
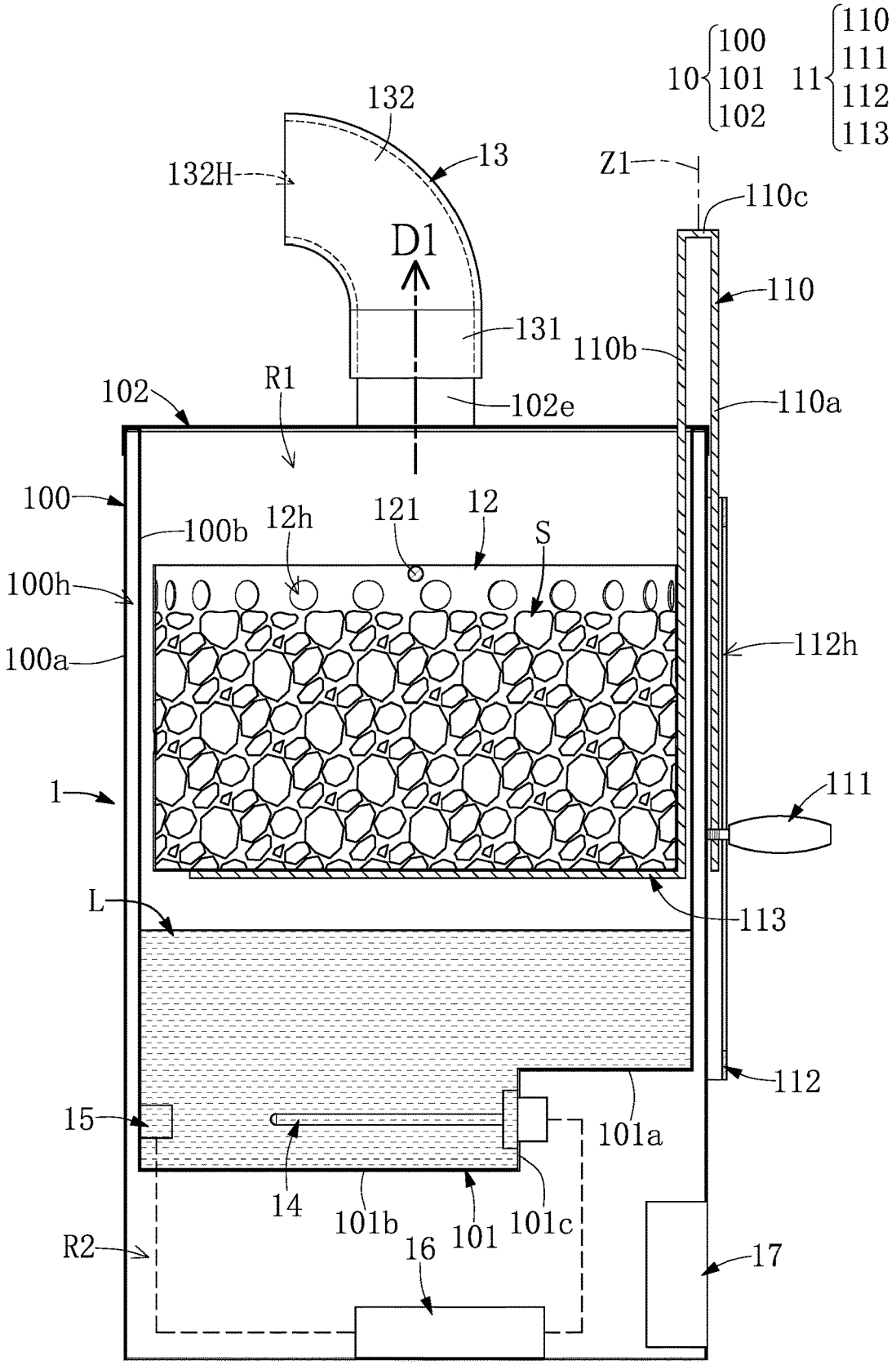
FIG. 6 shows a schematic diagram of the dry ice machine at a use state when the lifting member is located at a first predetermined position.
Figure 7:
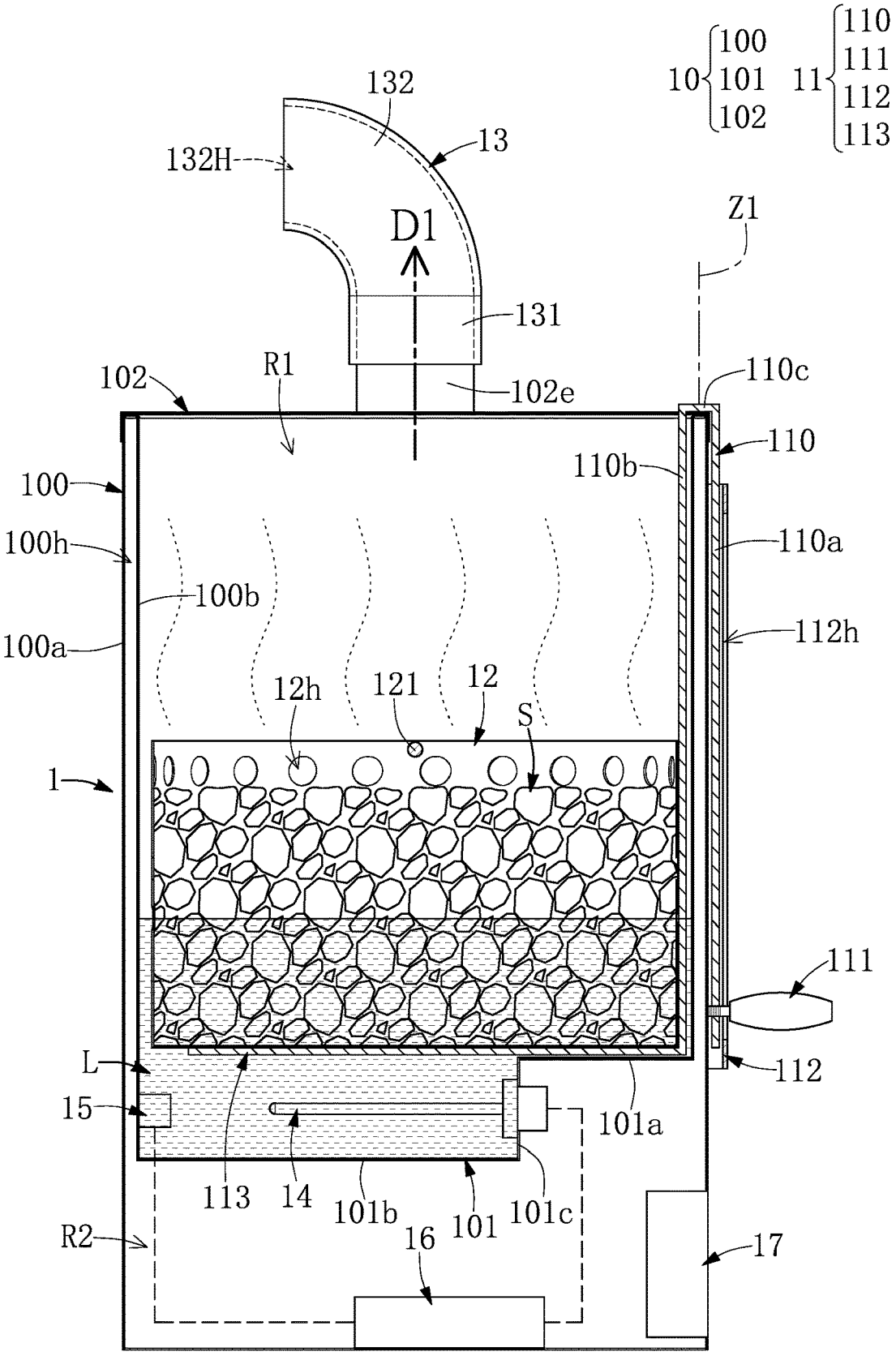
FIG. 7 shows a schematic diagram of the dry ice machine at the use state when the lifting member is located at a second predetermined position.

Reference is made to FIG. 6 and FIG. 7, which respectively show schematic diagrams of the lifting member of the dry ice machine located at different predetermined positions according to the embodiment of the present disclosure in different usage states. As shown in FIG. 6, the lifting member 110 can be pulled up and then be fixed at a first predetermined position along the lifting axis Z1 by controlling the operating member 111. The liquid L in the liquid containing space R1 has been heated by the heating assembly 14 to a predetermined temperature, such as 70° C. to 80° C. In addition, the dry ice container 12 carrying the dry ice pellets S is disposed on the support portion 113 of the lifting assembly 11. Meanwhile, the position of the dry ice container 12 is higher than the surface of the liquid L and not in contact with the liquid L. The top cover 102 is disposed on the outer casing 10 and closes the liquid containing space R1.

During the process of fog generation, the pin portion 111*b* of the operating member 111 (as shown in FIG. 5B) will be loosened by the user, so that the lifting member 110 can move downwardly in relation to the outer casing 10. As shown in FIG. 7, after the lifting member 110 is driven to descend by the user moving the operating member 111, the heated liquid L can flow through the through holes 12*h* of the dry ice container 12 and be in contact with the dry ice pellets S to generate the fog. As the amount of the fog increases, the pressure in the liquid containing space R1 will also increase and consequently lead to the discharge of the fog to the outside of the dry ice machine 1 through the fog outlet pipe 13, creating an effect of permeating clouds on the stage.

It is worth mentioning that the height position of the dry ice container 12 determines the contact area between the dry ice pellets S and the liquid L, and affects the amount of fog and the pressure in the liquid containing space R1, thereby affecting the fog effects to be generated. Since the dry ice container 12 is driven by the lifting member 110, the amount of fog can be controlled by controlling the position of the lifting member 110. Accordingly, after the dry ice container 12 is driven downwardly by the lifting member 110 to a specific position, the pin portion 111*b* of the operating member 111 can be pushed by the user to abut against the outer side wall 100*a* of the main housing 100 (as shown in FIG. 5A) so that the lifting member 110 can be fixed at a second predetermined position and continuously generate the fog required for the performance.

When the generation of fog needs to be adjusted or stopped, the user can again loosen the pin portion 111*b* of the operating member 111 again, and move the grip portion 111*a* to drive the lifting member 110 to another predetermined position relative to the outer casing 10.

Figure 8A:
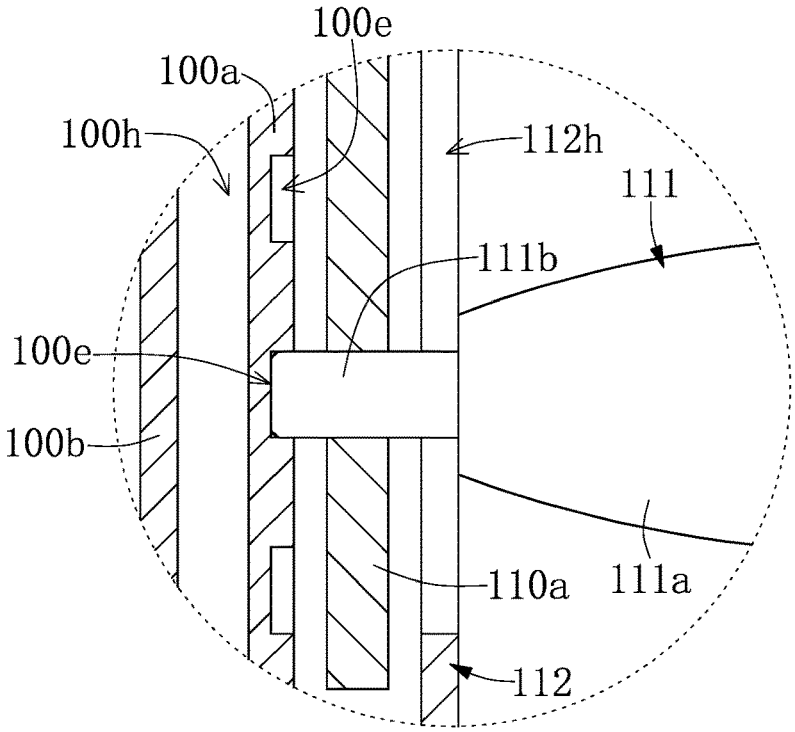
FIG. 8A shows a partial enlarged view of the operating member in a fixed state according to another embodiment of the present disclosure.
Figure 8B:
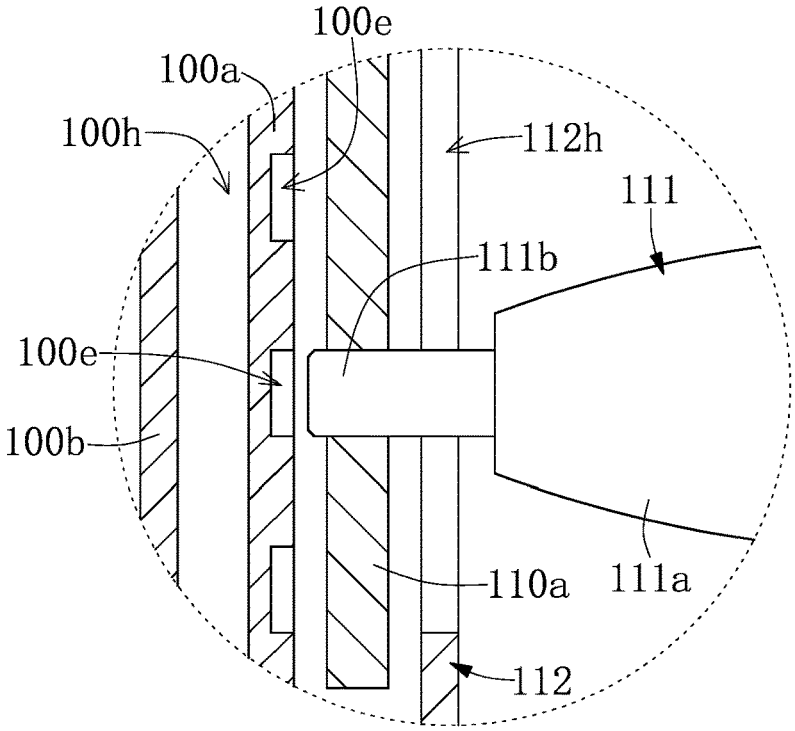
FIG. 8B shows a partial enlarged view of the operating member in a movable state according to another embodiment of the present disclosure.

Reference is made to FIG. 8A and FIG. 8B, which respectively show partial enlarged views of the operating member in a fixed state and a movable state according to another embodiment of the present disclosure. The elements of this embodiment which are similar to or the same as those shown in FIG. 5A are denoted by similar or the same reference numerals, and the same descriptions will not be reiterated herein.

In the instant embodiment, the outer side wall 100*a* of the main housing 100 has a plurality of positioning structures

100*e*, and the positions of the positioning structures 100*e* correspond to the trench 112*h* of the guide member 112. In other words, the positioning structures 100*e* are arranged along the extending direction of the trench 112*h* and located at the positions corresponding to the moving path of the lifting member 110. The positioning structures 100*e* may be, but are not limited to, positioning holes, protrusions, bumps, and the like. As shown in FIG. 8A, each of the positioning structures 100*e* of the instant embodiment is a positioning hole. When the lifting member 110 is moved to a predetermined position, the pin portion 111*b* of the operating member 111 is engaged with one of the positioning structures 100*e* so that the position of the lifting member 110 is fixed. In this embodiment, the front end of the pin portion 111*b* and the positioning structure 100*e* can be complement each other in shape.

Reference is made to FIG. 8B. When the position of the lifting member 110 needs to be adjusted, an external force can be applied to the grip portion 111*a* along a horizontal direction by the user so that the grip portion 111*a* moves away from the main housing 100. As such, the pin portion 111*b* can be separated from the corresponding positioning structure 100*e*, so that the operating member 111 is in a movable state, that is, the operating member 111 is movable along the trench 112*h*. At this time, the user can move the lifting member 110 relative to the guide member 112 by moving the operating member 111.

In the instant embodiment, the pin portion 111*b* of the operating member 111 does not have a thread structure, but the present disclosure is not limited thereto. In another embodiment, the pin portion 111*b* of the operating member 111 may have a thread structure 1110 shown in FIG. 5A, and the outer plate body 110*a* of the lifting member 110 may have a screw hole, so that the pin portion 111*b* and the outer plate body 110*a* can be fastened with each other. In yet another embodiment, the pin portion 111*b* of the operating member 111 may include a blocking structure (not shown) located between the outer side wall 100*a* and the outer plate body 110*a*, which prevent the separation of the pin portion 111*b* from the outer plate body 110*a* of the lifting member 110 when the pin portion 111*b* is separated from the positioning structure 100*e*.

In one embodiment, a positioning member may also be disposed between the outer side wall 100*a* of the main housing 100 and the lifting member 110 (outer plate body 110*a*), and the positioning member has a plurality of positioning structures 100*e*. As long as the pin portion 111*b* can be fixed to a specific position, the means for fixing the pin portion 111*b* are not limited in the present disclosure.

It should be noted that when the user holds the operating member 111 to control the lifting of the dry ice container 12, the dry ice container 12 loaded with the dry ice pellets S may quickly fall into the liquid L due to mis-operation, which may cause a large amount of gas to generate within a short time, leading to an explosion of the dry ice machine 1 caused by excessive internal pressure. On account of this, in the instant embodiment, the operating member 111 further includes a mis-operation prevention structure to improve the safety of use.

Figure 9A:
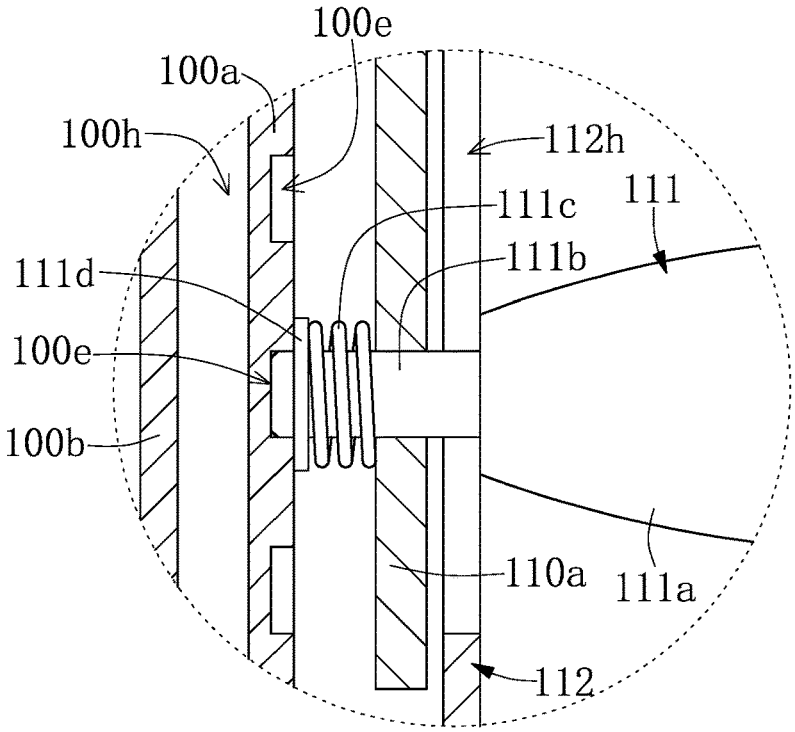
FIG. 9A shows a partial enlarged view of the operating member in a fixed state according to of another embodiment of the present disclosure.
Figure 9B:
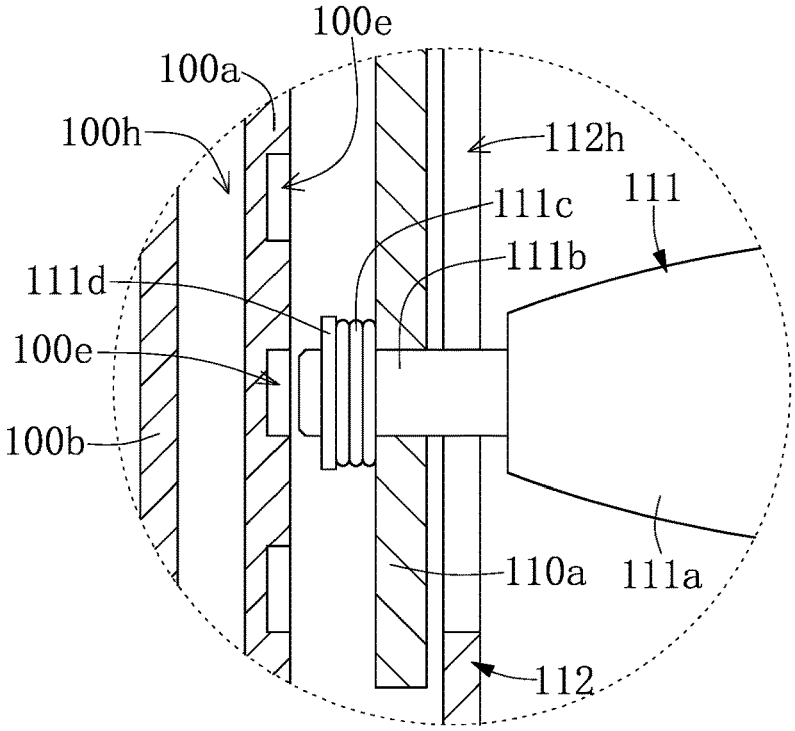
FIG. 9B shows a partial enlarged view of the operating member in a movable state according to another embodiment of the present disclosure.

Reference is made to FIG. 9A and FIG. 9B, which respectively show partial enlarged views of the operating member in a fixed state and a movable state according to another embodiment of the present disclosure. The elements of this embodiment which are similar to or the same as those shown in FIG. 8A are denoted by similar or the same reference numerals, and the same descriptions will not be reiterated herein.

In the instant embodiment, the outer side wall 100*a* of the main housing 100 has a plurality of positioning structures 100*e*, and the operating member 111 further includes an elastic member 100*c* and a flange 100*d* protruding from the front end of the pin portion 111*b*. The elastic element 100*c* may be a compression spring or a tension spring. As shown in FIG. 9A, the elastic member 100*c* is a compression spring, and two ends of the elastic member 100*c* are respectively connected to the flange 100*d* and the outer plate body 110*a* of the lifting member 110. When no external force is applied to the operating member 111, the flange 100*d* connected to the pin portion 111*b* abuts against the outer side wall 100*a* due to the elastic force of the elastic member 100*c*, so that the front end of the pin portion 111*b* is engaged with one of the positioning structures 100*e*.

Reference is made to FIG. 9B. When the grip portion 111*a* receives an external force along the horizontal direction and moves away from the main housing 100, the pin portion 111*b* is separated from the corresponding positioning structure 100*e*. At this time, the elastic member 100*c* is compressed between the flange 100*d* and the outer plate body 110*a* of the lifting member 110, so that the operating member 111 is in a movable state. That is to say, when the position of the lifting member 110 needs to be adjusted, the user can apply an external force to separate the pin portion 111*b* from the corresponding positioning structure 100*e*, and then move the operating member 111 to drive the lifting member 110 to move up or down relative to the guide member 112. When the lifting member 110 is moved along the lifting axis Z1, the user must continuously apply an external force along the horizontal direction to the grip portion 111*a*.

When the user does not apply force to the grip portion 111*a*, the pin portion 111*b* can be engaged with the closest positioning structure 100*e* by the resilience of the elastic member 100*c*, thereby fixing the positions of the lifting member 110 and the dry ice container 12. In this way, even if the user wrongly releases the grip portion 111*a* all of a sudden, the dry ice container 12 loaded with the dry ice pellets S can still be prevented from suddenly falling into the liquid L through the combined efforts among the elastic member 100*c*, the flange 100*d*, and the positioning structure 100*e*, thereby improving the operation safety of the dry ice machine 1.

It is worth mentioning that it is not necessary for the positioning structure 100*e* to be disposed on the outer side wall 100*a* of the main housing 100. In another embodiment, a positioning member may also be disposed between the outer side wall 100*a* and the lifting member 110 (outer plate body 110*a*), and the positioning member has a plurality of positioning structures 100*e*. In other words, as long as the pin portion 111*b* can be fixed to a specific position, the present disclosure is not limited to the means for fixing the pin portion 111*b* provided herein.

In conclusion, one of the advantages of the present disclosure is that in the dry ice machine 1 provided in the present disclosure, by the technical features of "the lifting member 110 being movably disposed on the outer casing 10," and "the dry ice container 12 being driven to be ascended or descended by the ascending or descending of the lifting member 110 to control the contact area between the dry ice pellets and the liquid," and "the fog outlet pipe 13 being detachably assembled to the outer casing 10 and including a backflow section 131 and a bending section 132 connected to the backflow section 131 so as to guide the fluid in the liquid containing space to the outside", a large amount of water fog can be released per unit time without remaining water stains on the stage.

Compared with the method of pumping water into the dry ice chamber to generate cloud and fog by using a pump, the dry ice machine 1 of the embodiment of the present disclosure can generate a larger amount of fog and has a faster fog output rate. In addition, the extension direction D1 of the backflow section 131 of the fog outlet pipe 13 of the embodiment of the present disclosure is different from the fog outlet direction, and forms an acute angle of less than 90 degrees with the lifting axis Z1, so that the water droplets (or condensation) in the fog can condense on the inner wall surface of the backflow section 131 and flow back into the liquid containing space R1 to reduce the humidity of the fog.

The fog discharged by the dry ice machine 1 of the embodiment of the present disclosure may not bring the water droplets that have condensed in the backflow section 131 to the stage, and prevent the formation of a water film on the stage. Therefore, compared with the conventional dry ice apparatus, the dry ice machine 1 of the embodiment in the present disclosure not only generates a large amount of fog to achieve the expected stage effect, but also prevents water stains from remaining on the stage, thus reducing the risk of slipping for performers on the stage floor.

On the other hand, there is no need for a power cord that connects the dry ice machine 1 of the embodiment in the present disclosure with an external power supply during the generation of fog, which can prevent the performer from stumbling. The dry ice machine 1 can also be placed at any position of the side of the stage according to the actual situation.

To be more specific, the operating member 111 of the dry ice machine 1 in one of the embodiments of the present disclosure further includes a structure for prevent misoperation. By the technical features of "the outer side wall 100*a* of the main housing 100 including a plurality of positioning structures 100*e*" and "the operating member 111 including the elastic member 100*c* and the flange 100*d* protruding from the front end of the pin portion 111*b*," the danger due to the user's misoperation can be prevented, thus further improving the operation safety of the dry ice machine 1.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A dry ice machine, comprising:

an outer casing having a liquid containing space;

a lifting assembly including a lifting member and an operating member, wherein the lifting member is movably disposed on the outer casing, and the operating member is connected to the lifting member to drive the lifting member to move along a lifting axis relative to the outer casing;

a dry ice container for carrying dry ice pellets detachably assembled to the lifting member, wherein the dry ice container has a plurality of through holes, so that an internal space of the dry ice container is in spatial communication with the liquid containing space, when the lifting member is ascended or descended, the dry ice container is driven by the lifting member to be ascended or descended;

a fog outlet pipe detachably assembled to the outer casing and including a backflow section and a bending section connected to the backflow section so as to guide the fog generated in the liquid containing space to the outside of the outer casing;

wherein the outer casing includes a main housing defining the liquid containing space, and the operating member includes a pin portion and a grip portion that are connected to each other;

wherein when the operating member is in a fixed state, the pin portion penetrates the lifting member and abuts against the main housing; and when the operating member is in a movable state, the pin portion is connected to the lifting member without being in contact with the main housing.

2. The dry ice machine according to claim 1, wherein, the outer casing includes a main housing surrounding the liquid containing space, a wall of the main housing has a hollow structure that is filled with a thermal insulation medium.

3. The dry ice machine according to claim 1, wherein the outer casing includes a main housing surrounding the liquid containing space, the lifting member has a U-shaped structure, and the U-shaped structure is disposed on a wall of the main housing with an opening thereof facing toward the main housing.

4. The dry ice machine according to claim 1, wherein the lifting member includes an inner plate body extending into the liquid containing space, an outer plate body located outside of the outer casing, and a bridging portion connected between the inner plate body and the outer plate body, and the operating member is connected to the outer plate body.

5. The dry ice machine according to claim 4, wherein the lifting assembly further includes a support portion for supporting the dry ice container, the support portion is connected to the inner plate body, and when the dry ice container is disposed in the liquid containing space, the support portion is located at the bottom of the dry ice container.

6. The dry ice machine according to claim 1, wherein the outer casing includes a main housing defining the liquid containing space, and the lifting assembly further includes a guide disposed on an outer side wall of the main housing and having a trench extending along the lifting axis, the lifting member is movably disposed between the guide member and the main housing, and the operating member is connected to the lifting member through the trench.

7. The dry ice machine according to claim 1, wherein the main housing further includes a plurality of positioning structures, and the positioning structures are located on an outer side wall of the main housing and arranged corresponding to a moving path of the lifting member;

when the operating member is in a fixed state, the pin portion is engaged with one of the positioning structures.

8. The dry ice machine according to claim 1, wherein the operating member further includes an elastic member and a flange protruding from a front end of the pin portion, and two ends of the elastic member are respectively connected to the flange and the lifting member.

9. The dry ice machine according to claim 1, wherein the outer casing includes a main housing defining the liquid containing space and a top cover for closing the liquid containing space, the backflow section is detachably assembled to the top cover, an extension direction of the backflow section and the lifting axis jointly form an acute angle therebetween, the bending section has a spout, and is bent relative to the extension direction of the backflow section to form a bending angle, and the bending angle is greater than the acute angle.

10. The dry ice machine according to claim 1, further comprising a heating assembly disposed in the liquid containing space to heat the liquid.

11. The dry ice machine according to claim 10, further comprising: a control module and a temperature sensor, wherein the temperature sensor is disposed in the liquid containing space to detect a temperature of the liquid, and the control module is electrically connected to the heating assembly and the temperature sensor, and controls the power provided to the heating assembly according to the temperature detected by the temperature sensor.

* * * * *